United States Patent [19]

Kiesel et al.

[11] Patent Number: 4,744,309

[45] Date of Patent: May 17, 1988

[54] TABLE FOR DENTAL TOOLS

[75] Inventors: Helmut Kiesel, Bensheim; Tilmann Phleps, Lorsch, both of Fed. Rep. of Germany

[73] Assignee: Siemens Aktiengesellschaft, Berlin and Munich, Fed. Rep. of Germany

[21] Appl. No.: 945,175

[22] Filed: Dec. 22, 1986

Related U.S. Application Data

[63] Continuation of Ser. No. 721,532, Apr. 10, 1985, abandoned.

[30] Foreign Application Priority Data

Apr. 12, 1984 [DE] Fed. Rep. of Germany ..... 3413871

[51] Int. Cl.[4] ..... A47B 3/06

[52] U.S. Cl. ..... 108/157; 108/27

[58] Field of Search ..... 108/27, 157, 90; 248/154, 313, 316.1, 310; 433/79, 77, 74

[56] References Cited

U.S. PATENT DOCUMENTS

| | | | |
|---|---|---|---|
| 1,482,742 | 2/1924 | Gilchrist | 108/157 |
| 2,559,353 | 7/1951 | Fisch | 248/310 X |
| 2,620,089 | 12/1952 | Loghem | 248/310 X |
| 2,823,004 | 2/1958 | Melloh | 248/312.1 X |
| 2,911,700 | 11/1959 | Wieland | 248/310 X |
| 3,346,957 | 10/1967 | Maurer et al. | 433/79 |
| 3,704,675 | 12/1972 | Bellasalma | 108/152 |
| 4,071,218 | 1/1978 | Pecka et al. | 248/312.1 X |
| 4,275,940 | 6/1981 | Draper | 433/79 X |

FOREIGN PATENT DOCUMENTS

| | | | |
|---|---|---|---|
| 1953694 | 4/1971 | Fed. Rep. of Germany . | |
| 1290526 | 9/1972 | United Kingdom | 433/79 |

*Primary Examiner*—Kenneth J. Dorner
*Assistant Examiner*—José V. Chen
*Attorney, Agent, or Firm*—Lawrence C. Edelman

[57] ABSTRACT

A table for universal deposition of dental tools, is disclosed including a receiving part (3) the outer limitation of which contains at least over a portion of its perimeter a rim (4) with a rim end portion (**4*b*) extending downward in relation to the deposit surface (5) of the receiving part (3). The receiving part (3) is adapted to be attached to a mount (9) comprises a carrier (9) with a horizontal bearing surface (10) for the receiving part (3). A depression (11) is located in the carrier (9) and adapted to receive the rim end portion (4*b*) of the receiving part (3) to provide a mechanically locking engagement. The mount also includes a projection (12) which is arranged at a distance from the depression (11) corresponding to the rim height of the receiving part (3) and which extends at least partially over the upper surface (6) of the rim (4) when the receiving part (3) is placed on the carrier (9**).

12 Claims, 1 Drawing Sheet

TABLE FOR DENTAL TOOLS

CROSS-REFERENCE TO RELATED APPLICATIONS

This is a continuation of Ser. No. 721,532 filed Apr. 10, 1985, now abandoned.

BACKGROUND OF THE INVENTION

This invention relates to a table for dental tools, such as a set of instruments and the like, having a receiving part to be placed on a mount with a horizontal bearing surface and, in particular, the invention relates to a table which receives the tools directly or indirectly by way of a tray, and whose outer extreme includes at least, over part of its perimeter a rim with end portion drawn downward relative to the deposition surface of the receiving part.

For the deposition and readiness of dental tools, in particular a set of instruments, the dentist typically uses receiving elements in the form of trays or cassettes which can be deposited in appropriate depressions of special mounts usually installed on support arms, see U.S. Pat. No. 3,346,957, for example.

Available on the market are two types of trays whose dimensions are standardized, but which differ in size i.e. 285×185 mm and 345×245 mm. To make it possible for the cutomer to use either one of the trays, the equipment manufactuer must offer mounts for both tray sizes. This, however, means more stock-keeping. If the customer later changes the tray mount, retrofitting costs are involved.

In German Offenlengungsschrift No. 19 53 694 a mount for instrument trays which swivels in a horizontal plane and with a raised edge is disclosed. In a preferred embodiment of the mount, the bearing part receiving the tray is in the form of a horizontal U seen from the side. The lower leg of the U-shaped bearing part is formed as a wide fishplate, while the upper leg comprises a safety element which engages from behind the edge, inserted into the bearing part, of the instrument tray to be received. In one form of realization, this safety element has the form of a pivotably mounted lever which contains several teeth engaging the edge from behind.

Apart from the fact that the conventional construction is suitable solely for the retention of trays with a rim extending upward, the lever arrangement shown there has protruding parts, which not only should be avoided for hygienic reasons but also have the disadvantage that inadvertent actuation may occur and thus the tray may unintentionally disengage from its mount and fall. Furthermore, in this embodiment as well as in the other variations of the embodiment shown herein, particularly in the proposal of fixing the tray by means of a removable stud, the operational handling is relatively complicated so as to not permit engagement and disengagement operation.

It is a primary object of the invention to provide a table of the type for dental tools which has no holding or fixing members which protrude and therefore would tend to cause improper operation and where the receiving part, which can receive the tools directly or indirectly by way of a tray or cassette, can be exchanged relatively simply and easily by the user for another receiving part; refer to German p. 1(a)., lines 28–30 e.g. for the purpose of making it easier to prefit, clean or sterilize the receiving part. In fact, one handed operation is possible.

SUMMARY OF THE INVENTION

The invention takes the form of a table for dental tools wherein a receiving part is located on a mount having a horizontal bearing surface. The receiving part has a deposition surface which receives dental tools, e.g. a set of instruments directly or indirectly by way of a tray or cassette. The outer extreme of the table includes over at least a portion of the circumference a rim having a rim end portion which extends downward relative to the deposition surface of the receiving part. The mount for the receiving part includes a carrier which provides support for the receiving part. The carrier includes a depression which engages the rim end portion of the receiving part to provide mechanical locking thereto. At a distance from the depression correspnding to the height of the rim of the receiving portion, there is a projection which extends over at least a portion of the upper surface of the rim and holds down the receiving part when the carrier is placed thereon.

In one aspect of the invention, the receiving part includes a rim of a predetermined shape with rim portions extending upward relative to the deposition surface and lower rim end portions extending downward therefrom.

In some of the further aspects of the invention, the upper rim portions include a bevel. The receiving part has a circular rim whose cross section is constant in shape and has an area consistent with the size range of commercial trays. The carrier includes a carrying part that is longitudinally displaceable relative to a stationary part which provides the bearing surface. The carrier also includes a slot arranged and adapted to receive a guide element associated with the displaceable carrying part. The displaceable carrying part is pressed under the action of a spring against the stationary carrier at one end and, at the other end, in the direction of displacement against a stop.

The foregoing and other objects and aspects of the this invention will be more fully understood from the following descrtiption of an illustrative embodiment of the invention taken in conjunction with the accompanying drawing.

DETAILED DESCRIPTION

Figure 1:
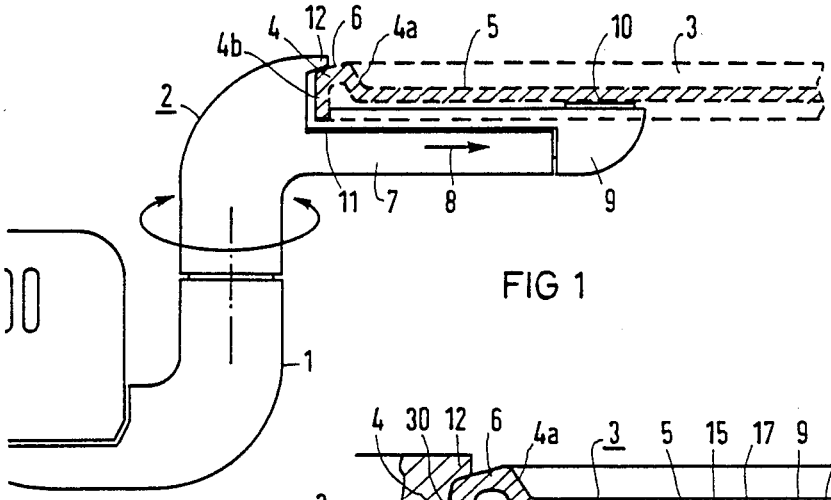
FIG. 1 illustrates a side elevation of an illustrative embodiment of a table in accordance with the principles of the invention.
Figure 3:
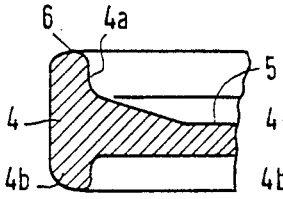
FIG. 3 shows one suitable cross-sectional shape for the rim portion of the table.
Figure 4:
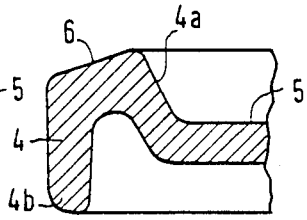
FIG. 4 illustrates another suitable cross-sectional shape for the rim portion of the table.

FIG. 1 shows a table according to the invention in a side view. On a wall or floor column 1 a bent holding arm 2 is pivotably mounted. This holding arm is the stationary carrier of a removably mounted receiving part 3, indicated in broken lines in the drawing, e.g. for a set of instruments. The receiving part 3 can receive the set of instruments directly or indirectly by way of one or more trays or cassettes. At least partially along the circumference, but preferably circling the entire circumference, the receiving part 3 contains a shaped (beaded) rim 4 with constant profile and cross-section. Two cross-sectional shapes are depicted in FIGS. 3 and 4. The rim 4 has an upper rim portion 4*a* raised in relation to the deposition surface 5, and a lower rim end portion 4*b* extending downward. In the upper rim region the rim 4 is provided with a bevel 6.

The holding arm 2 includes a mount fixed thereto for releasably engaging the rim 4 of the receiving part 3. The mount includes a support part 7 a fixed thereto and extending approximately to the center of the receiving part 3; on it is mounted a carrying part 9 displaceable lengthwise in the direction of the arrow 8. At its free end situated approximately at mid-width of the receiving part, the carrying part 9 contains a bearing or supporting surface 10, and at its other end a depression 11, formed for example by an undercut, in which the lower rim end portion 4*b* of the receiving part 3 can engage mechanically locking. In the engaged position, the receiving part is secured against extraction and also against rotation. In addition, at a distance from the depression corresponding to the height of the rim, the mount contains a projection 12 is afixed to holding arm 2, which extends a little over the bevel 6 of the receiving part 3 in the mounted state. Due to the projection, the receiving part is guided in its plane and is secured against falling out if inadvertently bumped from below.

Figure 2:
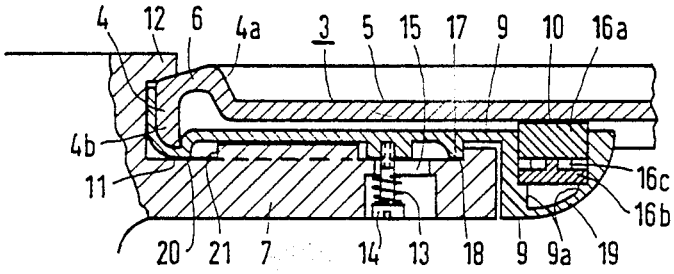
FIG. 2 depicts a cross-sectional view of the table of FIG. 1.

In FIG. 2, the bearing surface 10 is formed by two inlay parts 16*a*, 16*b* which are arranged one above the other, embedded in a corresponding recess in the carrying part 9, and resting against abutting surfaces 9*a* of the carrying part 9. The inlay part 16*b* is provided with spacers 16*c* and can be inserted turned around 180°. In the inserted position shown, a bearing surface raised somewhat in relation to the rest of the surface of the carrying part 9 is formed, and in the other inserted position, in which the spacers 16*c* are inactive, a bearing surface flush with the rest of the surface. By this selective position, receiving parts differently formed with respect to their edge configurations can be taken into account. Advantageously, the selected position can be marked on the inlay part.

The carrying part 9 made of a suitable material such as plastic and is guided spring-loaded by means of a guide pin or screw 14, in a slot 15 urged by a compression spring 13, the carrying part 9 being pushed toward the support part 7 by the spring action.

Figure 5:
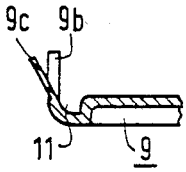
FIG. 5 is a cross-sectional view of a portion of the carrying port.

In FIG. 5, carrying part 9 is provided with an upright rim 9*b*, by which it can lie against the corresponding surface of the support part 7 or of the holding arm 2. By means of an elastic tongue 9*c* integrally molded on the rim 9*b* as shown in FIG. 5, certain tension and hence stabilization of the position is created for the carrying part 9.

In the engagement position shown in the drawing, in which the receiving part 3 is retained on the holding arm 2, a peg 17 lies against a preferably adjustable stop 18 of the support part 7. When the carrying part 9 is lifted by lifting of the end part 19, preferably formed as a handle, peg 17 will come to be above stop 18. Supported by the elastic tongue 9*c*, the carrying part slides out in the direction of arrow 8 until an edge 20 applies against an additional stop 21 of the support part 7. In this position, rim 4 lies outside the projection 12, so that the receiving part 3 can easily be taken off.

For snapping on, the sequence is reversed, i.e., first the receiving part 3 is inserted into the depression 11 by the lower rim end part 4*b*. Then the carrying part 9 is pushed in lightly counter to the direction of arrow 8. The bevel will then be under the projection. Thereafter the carrying part 9 is pressed down, so that peg 17 makes contact again on stop 18.

Figure 6:
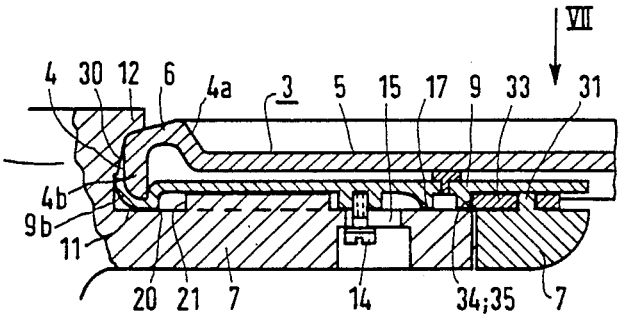
FIG. 6 is another embodiment of a support for receiving part 3.
Figure 7:
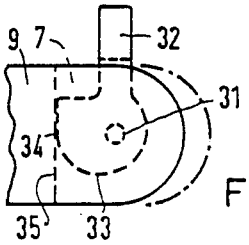
FIG. 7 is a top view of the support member 9 when receiving part 3 is removed.

FIGS. 6 and 7 illustrate another embodiment of a support for receiving part 3 and carrying part 9. In this embodiment, the support arm 2 comprises a declined contact surface 30 close (or "in the vicinity") to projection 12. The carrying part 9 contains a rim 9*b* which is less high as indicated in the embodiment of FIG. 5, and it also does not include elastic tongues 9*c*. Furthermore, spring 13 is no longer included which allows to lift carrying part 9 in the embodiment of FIG. 2. Therefore, the carrying part 9 in the embodiment of FIG. 6 and 7 is only shiftable in one plane in direction of arrow 8 (FIG. 1). Carrying part 9 is mounted by means of a lever 32 which is rotatably secured in support part 7 by means of bearing 31. The lever 32 comprises an eccentric cam 33 having a surface 34 which contacts surface 35 of the carrying part 9. By rotating of lever 32 the carrying part 9 is pressed in direction of holding arm 2. As a result, receiving part 3 is locked between declined surface 30 and projection 12 of holding arm 2 on one hand and is also locked in recess 11 of carrying part 9 on the other hand. Due to this construction a very stable attachment is provided.

It is to be understood that the rim configuration and size of the receiving part may in fact be varied without departing from the inventive principles. FIGS. 3 and 4 show as an example two differently formed profiles that enter into consideration for the receiving part 3. If, as proposed and preferred, the receiving profile has a circling rim profile of constant cross-section, the receiving part may be mounted at any desired straight outer edge. Also subsequent shifting is readily possible. Proceeding from such a basic profile, additional receiving element, such as medication containers, film viewers or also handles, can be mounted on such a receiving part in the same manner. Although specific embodiments of this invention have been shown and described, it will be understood that various modifications may be made without departing from the spirit of the invention and the scope as limited only by the appended claims.

What is claimed is:

1. A table assembly of the type for receiving dental tools, such as a set of instruments and the like, said table assembly comprising a holding arm, a mount attached to said holding arm and a receiving part which is releasably engaged with said mount, wherein:

said receiving part has a tool receiving bottom surface and a rim end portion having a predetermined height extending in a generally perpendicular direction relative to said bottom surface and encircling at least a portion of the perimeter of said bottom surface, said rim end portion having a lower rim edge extending downward relative to said bottom surface, and an upper rim edge;

said mount comprises a horizontally extending support part which in a longitudinal dimension of said support part is stationary with respect to said holding arm, a projection which is stationary with respect to said support part, and a carrying part mounted on said support part in a manner which allows movement in a longitudinal direction of said carrying part relative to said support part, said support part and said carrying part having guide elements coupled thereto for effecting said longitudinal movement of said carrying part relative to said support part;

said carrying part includes a depression therein dimensioned to engage with said downwardly extending lower rim edge of said receiving part; and said projection of said mount is vertically spaced at a distance from said depression of said carrying part corresponding substantially to said height of said rim end portion of said receiving part, said projection and said depression being adapted to engage said upper and lower rim edges of said receiving part, repectively, when the lower rim edge of said receiving part is positioned in said depression and said carrying part and receiving part are moved longitudinally in a first direction relative to said support part until said projection of said mount engages said upper rim edge of said receiving part.

2. The table assembly according to claim 1, wherein:

said upper rim edge of said receiving part extends upwardly from said bottom surface and has a bevelled shape angled so as to facilitate engagement of said upper rim edge of said receiving part with the projection of said mount when said receiving part and carrying part are moved longitudinally in said first direction.

3. The table assembly according to claim 1, wherein said rim end portion extends completely around the perimeter of said bottom surface of said receiving part and is of constant cross-section.

4. A table assembly according to claim 1, wherein:

said guide elements comprise a guide pin attached to said carrying part and a slot formed in said support part which receives said guide pin for defining the direction of said longitudinal movement of said carrying part relative to said support part.

5. A table assembly according to claim 4, further including:

spring means coupled with said carrying part which undergoes compression when said carrying part is moved in said first direction, thereby urging said carrying part to move in a second direction which is opposite said first direction; and said support part includes stop means which contacts said carrying part for preventing lateral movement of said carrying part in said second direction when said projection of said mount is engaged with said upper rim edge of said receiving part.

6. A table assembly according to claim 4, further including:

spring means coupled with said guide pin for urging said carrying part against said support part.

7. A table assembly according to claim 6, further including:

first and second stop means connected to both of said support part and said carrying part which, due to the urging of said spring means, act to limit said longitudinal movement of said carrying part relative to said support part in said second direction, said first stop means limiting said movement when said rim of said receiving part is engaged with said projection of said mount and said second stop means limiting said movement when said rim of said receiving part is not engaged with said projection of said mount.

8. A table assembly according to claim 1, wherein said carrying part comprises:

at least one inlay part forming a bearing surface for said receiving part; and selectively adjustable spacing means coupled between said carrying part and said inlay part which in a first adjustment causes said bearing surface of said at least one inlay part to be flush with a supporting surface of said carrying part and in a second adjustment causes said bearing surface of said at least one inlay part to be slightly elevated from said supporting surface of said carrying part.

9. A table assembly according to claim 8, wherein:

said selectively adjustable spacing means comprises a second inlay part and a spacer which abuts therewith, said first and second adjustments of said selectively adjustable spacing means corresponding to respective predetermined rotational orientations between said spacer and at least one of said first mentioned and said second inlay parts.

10. A table assembly according to claim 1, further including:

an eccentric lever means rotatably secured to said support part for selectively urging said carrying part to move in said first direction, due to rotation of said lever means, by an amount such that when said receiving part is positioned on said carrying part said rim end portion of said receiving part is locked in a space bounded by said projection on one hand and said depression on the other hand.

11. A table assembly according to claim 1, wherein:

said projection and support part are integrally formed in said holding arm.

12. A table assembly according to claim 1, wherein:

the size of said receiving part is such that commercial trays of a size range from 285×185 mm to 345×245 mm may be deposited thereon.

* * * * *